US011855380B2

(12) United States Patent
Yao et al.

(10) Patent No.: US 11,855,380 B2
(45) Date of Patent: Dec. 26, 2023

(54) ADAPTER, PLUG CONNECTOR ASSEMBLY AND CONNECTOR ASSEMBLY

(71) Applicants: Tyco Electronics (Shanghai) Co. Ltd., Shanghai (CN); SIBAS Electronics (Xiamen) Co. Ltd., Xiamen (CN)

(72) Inventors: Liqiang (Gino) Yao, Shanghai (CN); Yong (Chris) Wang, Shanghai (CN); Renzhong (Andy) Lin, Xiamen (CN); Qiang Yuan, Xiamen (CN)

(73) Assignees: Tyco Electronics (Shanghai) Co., Ltd., Shanghai (CN); Sibas Electronics (Xiamen) Co., Ltd., Xiamen (CN)

( * ) Notice: Subject to any disclaimer, the term of this patent is extended or adjusted under 35 U.S.C. 154(b) by 101 days.

(21) Appl. No.: 17/527,603

(22) Filed: Nov. 16, 2021

(65) Prior Publication Data

US 2022/0158379 A1 May 19, 2022

(30) Foreign Application Priority Data

Nov. 18, 2020 (CN) ..... 202011296571.6

(51) Int. Cl.

| | |
|---|---|
| ***H01R 13/422*** | (2006.01) |
| ***H01R 31/06*** | (2006.01) |
| ***H01R 13/24*** | (2006.01) |
| ***H01R 13/627*** | (2006.01) |

(52) U.S. Cl.

CPC ..... *H01R 13/4226* (2013.01); *H01R 13/2442* (2013.01); *H01R 13/6273* (2013.01); *H01R 31/06* (2013.01)

(58) Field of Classification Search

CPC ..... H01R 13/4226; H01R 13/2442; H01R 13/6273; H01R 31/06

See application file for complete search history.

(56) References Cited

U.S. PATENT DOCUMENTS

| | | | | |
|---|---|---|---|---|
| 4,620,762 | A * | 11/1986 | Davis | H05K 7/10 439/945 |
| 4,990,094 | A * | 2/1991 | Chandler | H01R 13/6596 D13/133 |
| 5,044,981 | A * | 9/1991 | Suffi | H01R 31/06 439/676 |
| 5,975,933 | A * | 11/1999 | Yamaguchi | H01R 13/73 439/247 |
| 6,273,756 | B1 * | 8/2001 | Ward | H01R 13/6592 439/372 |

(Continued)

*Primary Examiner* — Thanh Tam T Le
(74) *Attorney, Agent, or Firm* — Barley Snyder

(57) ABSTRACT

A plug connector assembly comprises a plug connector having an elastic locking structure for locking to a socket connector. The elastic locking structure is movable between a locking position engaged with the socket connector, and an unlocking position separated from the socket connector. An adapter of the assembly includes a pressing structure and a pull stop structure. The plug connector is received within the adapter for mating with the socket connector slidably inserted into the adapter. When the plug connector is received within the adapter, the pressing structure presses and holds the elastic locking structure in the unlocking position, and the pull stop structure abuts the elastic locking structure for preventing the plug connector from being pulled out of the adapter.

20 Claims, 7 Drawing Sheets

(56) References Cited

U.S. PATENT DOCUMENTS

| | | | | |
|---|---|---|---|---|
| 6,338,651 | B1 * | 1/2002 | Svette, Jr. | H01R 13/5202 439/560 |
| 6,352,433 | B2 * | 3/2002 | Hayashi | H01R 13/62972 439/364 |
| 7,094,099 | B2 * | 8/2006 | Daggett | H01R 13/745 439/567 |
| 7,361,054 | B2 * | 4/2008 | Kuo | H01R 13/745 439/607.41 |
| 8,845,207 | B2 * | 9/2014 | Lin | G02B 6/3825 385/139 |
| 9,466,928 | B2 * | 10/2016 | Luettermann | H01R 24/20 |
| 10,050,382 | B2 * | 8/2018 | Droesbeke | H01R 13/426 |
| 10,084,262 | B2 * | 9/2018 | Kelly | H01R 43/205 |
| 10,170,857 | B2 * | 1/2019 | Ho | H01R 13/629 |
| 10,211,571 | B2 * | 2/2019 | Khorrami | H01R 13/639 |
| 10,712,505 | B2 * | 7/2020 | Liao | G02B 6/3825 |
| 11,146,020 | B2 * | 10/2021 | Watanabe | H01R 13/518 |
| 11,169,332 | B2 * | 11/2021 | Ott | G02B 6/3825 |

* cited by examiner

ADAPTER, PLUG CONNECTOR ASSEMBLY AND CONNECTOR ASSEMBLY

CROSS-REFERENCE TO RELATED APPLICATIONS

This application claims the benefit of Chinese Patent Application No. 202011296571.6 filed on Nov. 18, 2020 in the State Intellectual Property Office of China, the whole disclosure of which is incorporated herein by reference.

FIELD OF THE INVENTION

The present invention relates to an adapter for use with an electrical connector assembly, and more particularly, to adapter for use with an RJ45 socket connector and plug connector, by way of example.

BACKGROUND

In the prior art, both RJ45 plug connectors and RJ45 socket connectors are standardized connector products. Generally, a housing of RJ45 plug connector includes an elastic locking structure and an unlocking pressing part for actuating the elastic locking structure. When the RJ45 plug connector and the RJ45 socket connector are mated together, the elastic locking structure on the RJ45 plug connector is oriented in a locked position in which the elastic locking structure is engaged with the RJ45 socket connector, thus locking the RJ45 plug connector and the RJ45 socket connector together. Therefore, when the RJ45 plug connector needs to be removed from the RJ45 socket connector, the elastic locking structure must be biased or pressed into an unlocked position in which the elastic locking structure is separated from the RJ45 socket connector by the unlocking pressing part, after which the RJ45 plug connector can be removed. However, as the elastic locking structure needs to be pressed to the unlocked position by the unlocking pressing part, a quick unplugging operation between the RJ45 plug connector and the RJ45 socket connector cannot be realized.

SUMMARY

According to an embodiment of the present disclosure, a plug connector assembly comprises a plug connector having an elastic locking structure for locking to a socket connector. The elastic locking structure movable between a locking position engaged with the socket connector, and an unlocking position separated from the socket connector. An adapter of the assembly includes a pressing structure and a pull stop structure. The plug connector is received within the adapter for mating with the socket connector slidably inserted into the adapter. When the plug connector is received within the adapter, the pressing structure presses and holds the elastic locking structure in the unlocking position, and the pull stop structure abuts the elastic locking structure for preventing the plug connector from being pulled out of the adapter.

BRIEF DESCRIPTION OF THE DRAWINGS

The invention will now be described by way of example with reference to the accompanying Figures, of which.

DETAILED DESCRIPTION OF THE EMBODIMENTS

Figure 1:
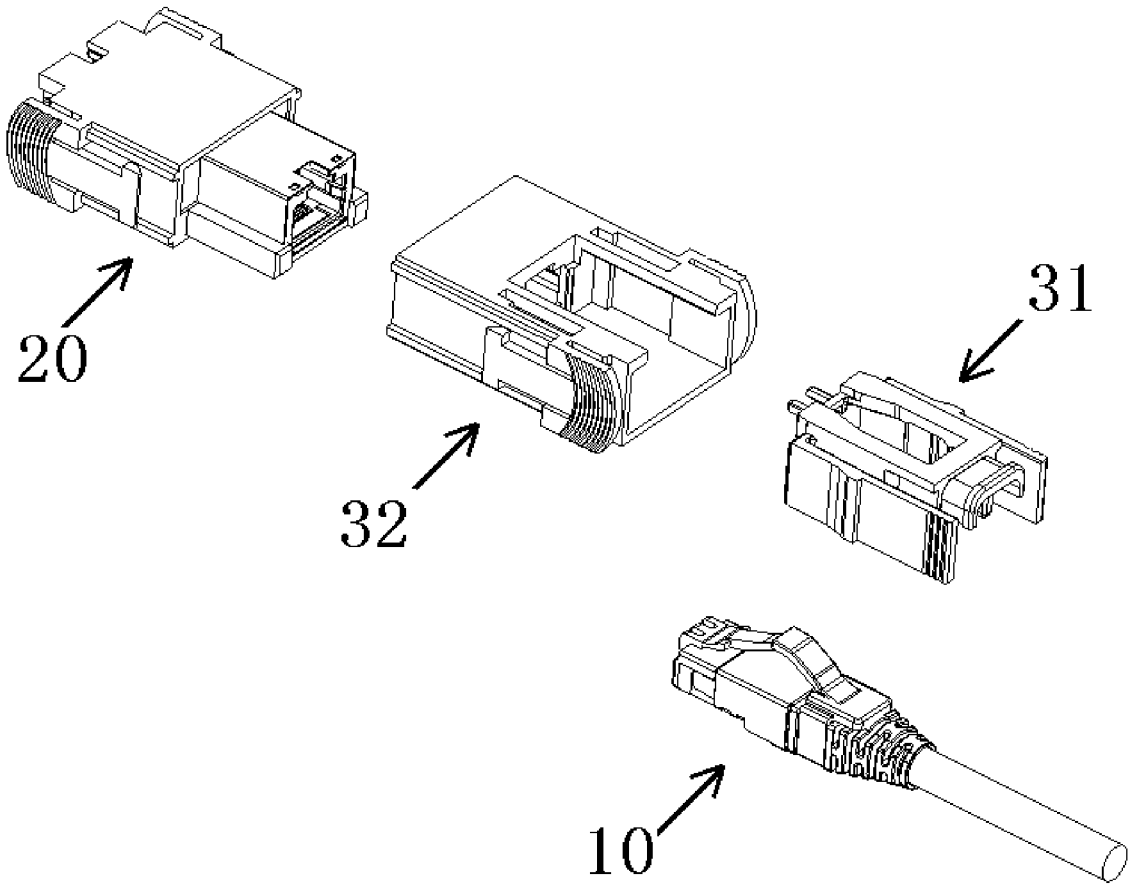
FIG. 1 is an illustrative exploded view of a connector assembly viewed from top according to an exemplary embodiment of the present invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a plug connector assembly comprises a plug connector having an elastic locking structure adapted to be locked to a socket connector, and an adapter having a pressing structure and a pull stop structure. The plug connector and the socket connector are adapted to be inserted into the adapter for mating the plug connector to the socket connector. The elastic locking structure is adapted to be moved between a locking position engaged with the socket connector and an unlocking position separated from the socket connector. When the plug connector is assembled in the adapter, the pressing structure presses and holds the elastic locking structure in the unlocking position, and the pull stop structure abuts the elastic locking structure to prevent the plug connector from being pulled out of the adapter.

According to another embodiment of the present disclosure, a connector assembly comprises the above plug connector assembly and a socket connector adapted to be inserted into the adapter of the plug connector assembly to mate with the plug connector arranged within the adapter. The adapter is adapted to be slidably inserted over, or otherwise slidably connected to, the socket connector in a friction-fit manner and without any positive locking engagement. IN this way, quick and efficient disconnection of the plug connector (and adapter) from the socket connector via the application of force in a single direction is realized.

According to another embodiment of the present disclosure, an adapter for mating a plug connector and a socket connector is provided. The plug connector is adapted to be assembled in or inserted into the adapter to mate with the socket connector inserted into the adapter. The plug connector comprises an elastic locking structure adapted to be moved between a locking position in which the elastic locking structure is engaged with the socket connector, and an unlocking position in which the elastic locking structure is separated from the socket connector. The adapter has a pressing structure and a pull stop structure. When the plug connector is installed within the adapter, the pressing structure presses and holds the elastic locking structure in the unlocking position, and the pull stop structure engages with the elastic locking structure to prevent the plug connector from being pulled out of the adapter.

Figure 2:
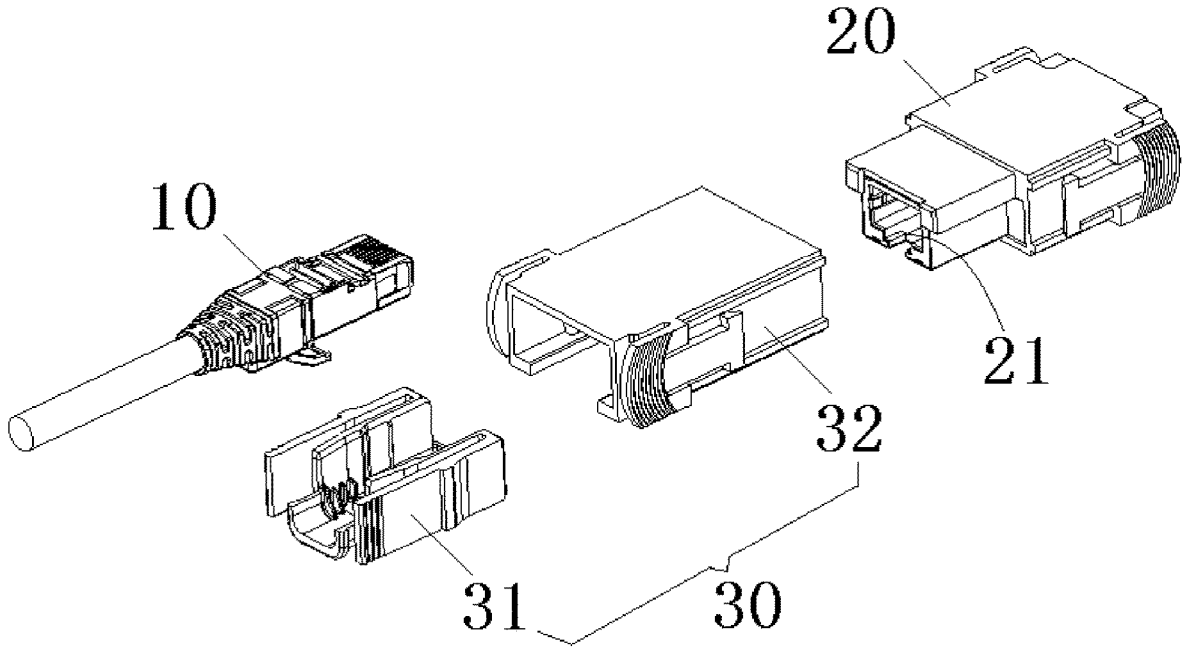
FIG. 2 is an illustrative exploded view of a connector assembly viewed from bottom according to an exemplary embodiment of the present invention.

FIG. 1 is an illustrative, top exploded view of a connector assembly according to an exemplary embodiment of the present disclosure. FIG. 2 is an illustrative, bottom exploded view of a connector assembly according to an exemplary embodiment of the present disclosure. As shown in FIGS. 1 and 2, in an embodiment, the connector assembly comprises a plug connector 10, a socket connector 20, and an adapter 30. The plug connector 10 is adapted to be assembled or inserted into the adapter 30 to mate with the socket connector 20 inserted into the adapter. See FIG. 7.

Figure 3:
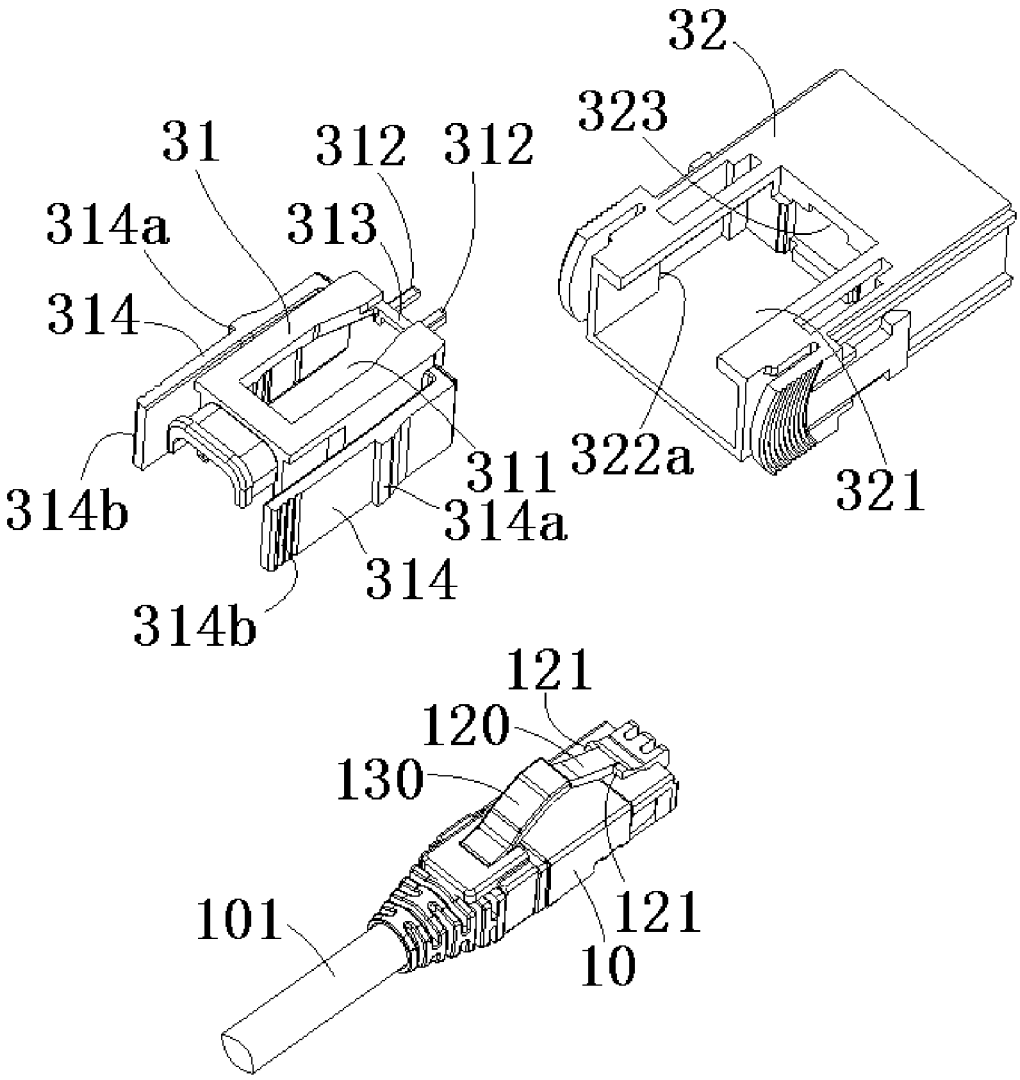
FIG. 3 is an illustrative exploded view of a plug connector assembly in the connector assembly shown in FIG. 1.

FIG. 3 is an illustrative exploded view of a plug connector assembly in the connector assembly shown in FIG. 1. As shown in FIGS. 1-3, in an embodiment, the plug connector 10 comprises an elastic locking structure 120, 121 adapted to be locked to the socket connector 20. The elastic locking structure 120, 121 is adapted to be moved between a locking position engaged with the socket connector 20 and an unlocking position separated from the socket connector 20.

Figure 4:
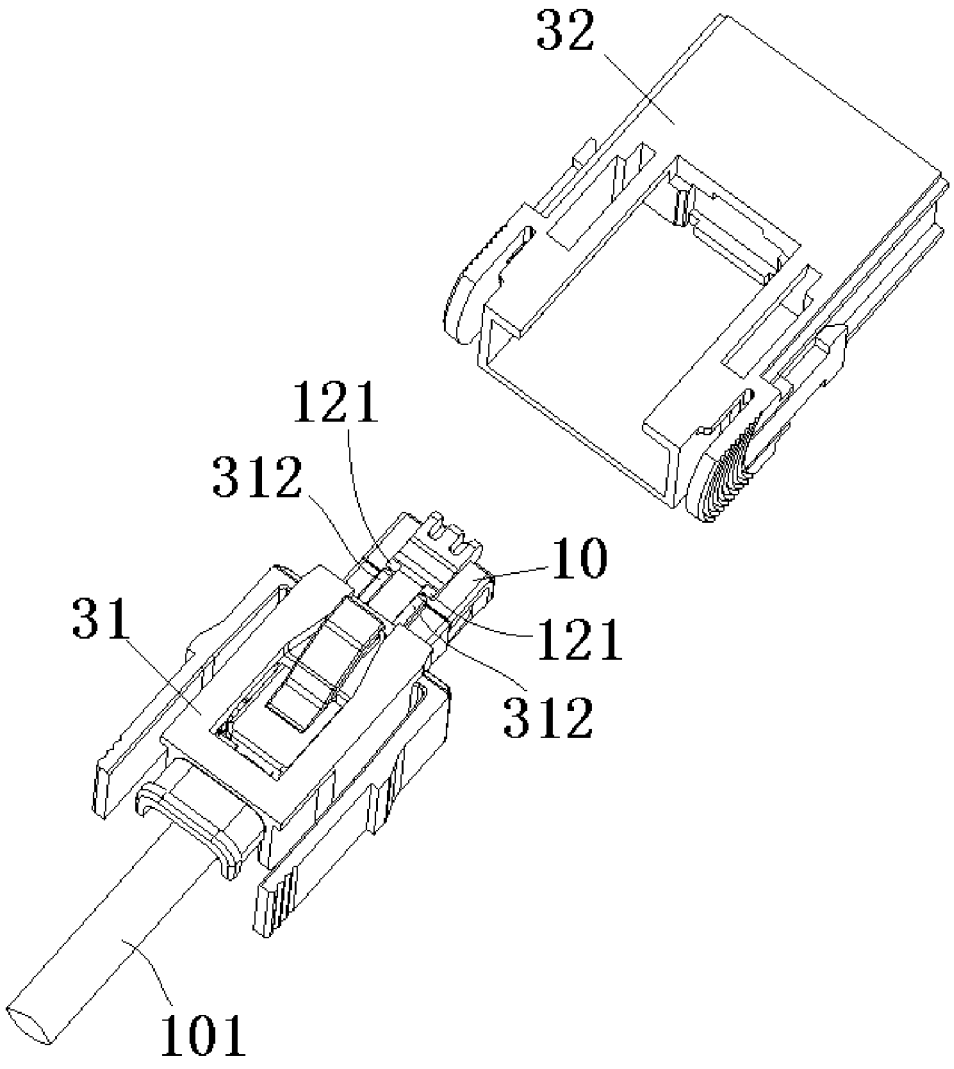
FIG. 4 is an illustrative view the plug connector assembly shown in FIG. 3, in which the plug connector is assembled into the inner housing of the adapter.
Figure 5:
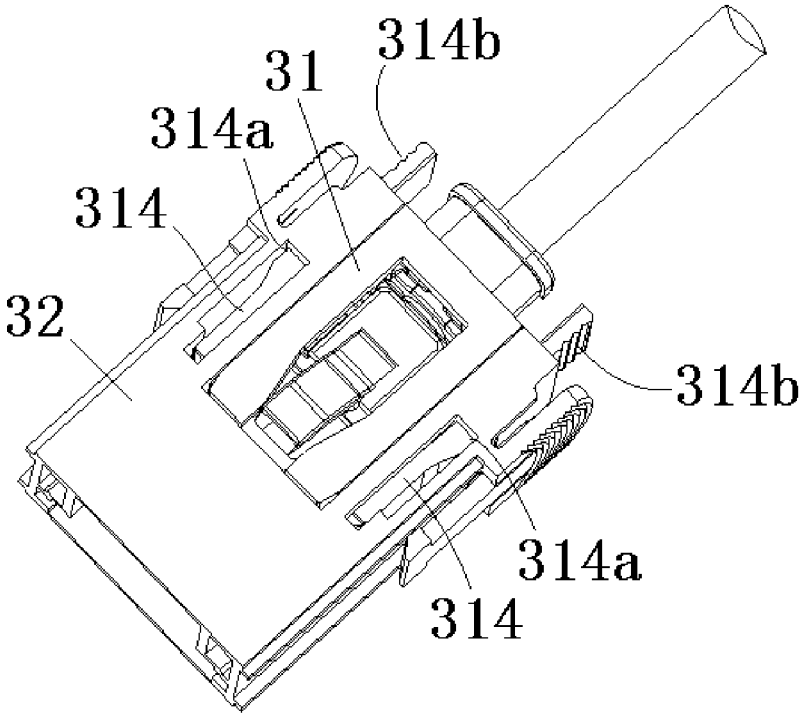
FIG. 5 shows an assembly view of the plug connector assembly shown in FIG. 3.
Figure 6:
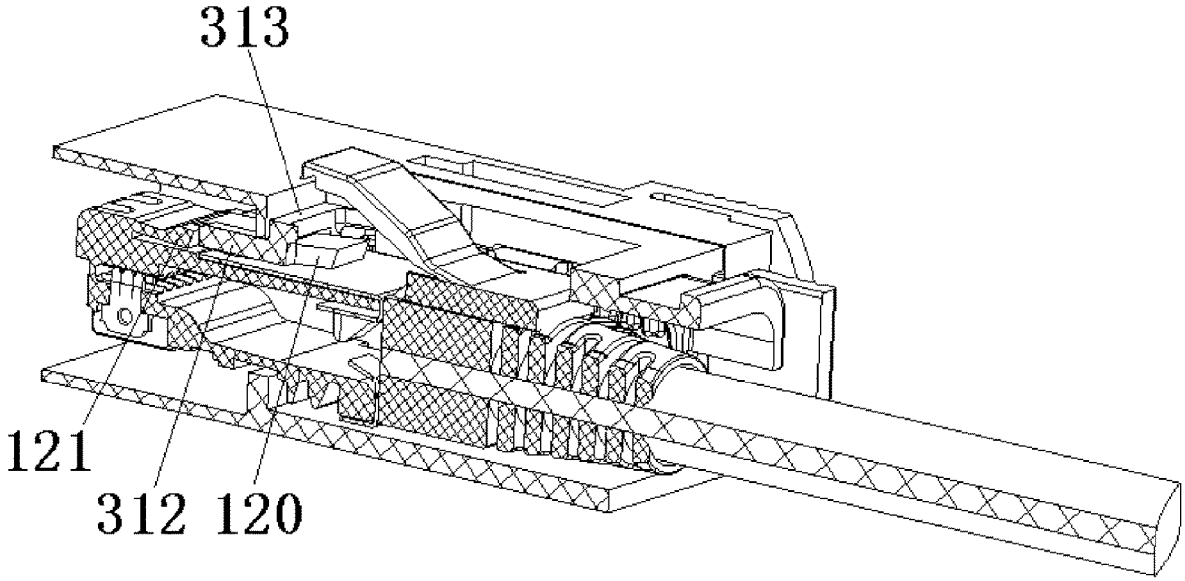
FIG. 6 shows a sectional view of the plug connector assembly shown in FIG. 5.

FIG. 4 is an illustrative view the plug connector assembly shown in FIG. 3, in which the plug connector 10 is assembled into the inner housing of the adapter 30. FIG. 5 shows an assembly view of the plug connector assembly shown in FIG. 3. FIG. 6 shows a sectional view of the plug connector assembly shown in FIG. 5. As shown in FIGS. 1-6, in an exemplary embodiment of the present disclosure, a plug connector assembly comprises the plug connector 10 and the adapter 30. The plug connector 10 is adapted to be assembled into the adapter 30 to mate with the socket connector 20 inserted into the adapter.

In an exemplary embodiment, the adapter 30 has a pressing structure 313, 323 and a pull stop structure 312. As the plug connector 10 is assembled in the adapter 30, the pressing structure 313, 323 presses and holds the elastic locking structure 120, 121 in the unlocking position, and the pull stop structure 312 abuts an opposing surface the elastic locking structure 120, 121 in a removal direction for preventing the plug connector from being pulled out of the adapter. Therefore, as the plug connector 10 is assembled or inserted into the adapter 30, the plug connector cannot be pulled out from the adapter by pulling the cable 101 at the rear end of the plug connector.

According to an embodiment, the elastic locking structure 120, 121 comprises an elastic arm 120 provided on a housing 110 of the plug connector 10, and a pair of locking protrusions 121 provided on both sides of the elastic arm. When the elastic arm 120 is in a release state in which it is not pressed down, the pair of locking protrusions 121 are in the locking position. When the elastic arm 120 is in a pressed downwardly, the pair of locking protrusions 121 are in the unlocking position.

Still referring to FIGS. 1-6, the adapter 30 comprises an inner housing 31 and an outer housing 32. The plug connector 10 is adapted to be assembled in the inner housing 31 of the adapter 30, and the inner housing 31 is adapted to be assembled in the outer housing 32. With the plug connector 10 assembled within the adapter 30, the elastic arm 120 is pressed down by the pressing structure 313, 323, and the pull stop structure 312 abuts the pair of locking protrusions 121. The pull stop structure 312 comprises a pair of pillars 312 formed on the inner housing 31, and front ends of the pair of pillars 312 are adapted to abut the pair of locking protrusions 121 to prevent the plug connector 10 from being pulled out of the adapter 30.

The pressing structure 313, 323 comprises a cross beam 313 connected between the pair of pillars 312, and the cross beam 313 is adapted to press down the elastic arm 120 so that the pair of locking protrusions 121 are in the unlocking position. In an embodiment, the pressing structure 313, 323 further comprises a pressing part 323 formed on the inner wall of the outer housing 32, the pressing part is adapted to press down the elastic arm 120 so that the pair of locking protrusions 121 are in the unlocking position.

It should be understood that the elastic arm 120 can be pressed down simultaneously by the cross beam 313 and the pressing part 323, or only by one of the cross beam or the pressing part. Therefore, it is possible that only the cross beam 313 is provided without the pressing part 323. Alternatively, it is also possible that only the pressing portion 323 is provided without the cross beam 313.

In one embodiment, an elastic latching structure 314, 314*a*, 314*b* is respectively provided on two outer side walls of the inner housing 31. When the inner housing 31 is assembled in the outer housing 32, the elastic latching structure 314, 314*a*, 314*b* is engaged with the inner wall of the outer housing 32, so as to lock the inner housing 31 to the outer housing 32. The elastic latching structure 314, 314*a*, 314*b* comprises an elastic cantilever 314 and a latching protrusion 314*a* formed on the outside of the elastic cantilever. Two locking steps 322*a* are respectively formed on the two inner side walls of the outer housing 32. When the inner housing 31 is assembled in the outer housing 32, the latching protrusion 314*a* is engaged with the locking step 322*a*, so as to lock the inner housing to the outer housing.

According to one embodiment, when the inner housing 31 is assembled in the outer housing 32, a free end 314*b* of the elastic cantilever 314 is located outside the outer housing, such that the latching protrusion 314*a* is capable of being separated from the locking step 322*a* by pressing the free end.

As shown in FIGS. 1-6, the plug connector 10 also comprises an unlocking pressing part 130. The unlocking pressing part 130 is configured to press the elastic locking structure 120, 121 to the unlocking position. The unlocking pressing part 130 is an elastic pressing arm extending obliquely upward from the top of the plug connector 10. A first opening 311 and a second opening 321 are respectively formed on the top walls of the inner housing 31 and the outer housing 32 of the adapter 30. The unlocking pressing part 130 is exposed through the first opening 311 and the second opening 321.

The bottom of the inner housing 31 is opened, and the plug connector 10 is adapted to be installed into the inner housing 31 from a bottom opening of the inner housing. After the plug connector 10 is assembled into the inner housing 31, the inner housing and the plug connector assembled in the inner housing are inserted into the outer housing 32 together.

According to one an embodiment, the plug connector is an RJ45 plug connector, and the socket connector is an RJ45 socket connector. As both RJ45 plug connector and RJ45 socket connector are standardized connectors, the present application will not describe their structure in detail.

Figure 7:
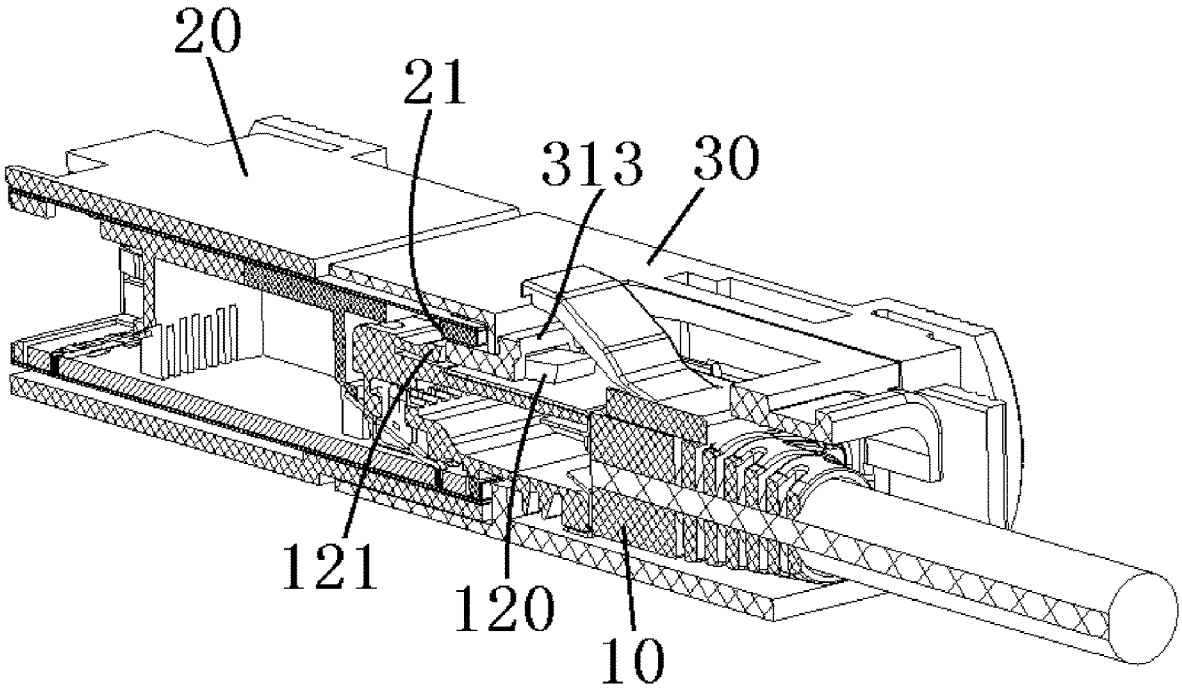
FIG. 7 is an illustrative view of mating a socket connector with the plug connector assembly shown in FIG. 5.

FIG. 7 is an illustrative view showing the mating of a socket connector with the plug connector assembly shown in FIG. 5. As shown in FIGS. 1-2 and 7, in an exemplary embodiment, the connector assembly comprises the above plug connector assembly and the above socket connector 20. The socket connector 20 is adapted to be inserted into the adapter 30 of the plug connector assembly for mating with the plug connector 10 assembled in the adapter.

A locking feature 21 is formed on an inner wall of a housing of the socket connector 20. The locking feature 21 is adapted to engage with the elastic locking structure 120, 121 on the plug connector 10. When the socket connector 20 is inserted into the adapter 30 and mated with the plug connector 10, the elastic locking structure 120, 121 is in the unlocking position in which the elastic locking structure is separated from the locking feature 21, so as to allow the socket connector to be pulled out from the adapter via the application of a force in only a single direction. In this way, an efficient and quick plugging operation between the plug connector 10 and the socket connector 20 can be realized.

In another exemplary embodiment of the present disclosure, as shown in FIGS. 1-2 and FIG. 7, an adapter for mating the plug connector 10 and the socket connector 20 is shown. The plug connector 10 is adapted to be assembled in the adapter 30 to mate with the socket connector 20 inserted into the adapter. The plug connector 10 comprises an elastic locking structure 120, 121 adapted to be moved between a locking position in which the elastic locking structure is engaged with the socket connector 20, and an unlocking position in which the elastic locking structure is separated from the socket connector. The adapter 30 has a pressing structure 313, 323 and a pull stop structure 312. When the plug connector 10 is assembled in the adapter 30, the pressing structure 313, 323 presses and holds the elastic locking structure 120, 121 in the unlocking position, and the pull stop structure 312 abuts the elastic locking structure 120, 121 to prevent the plug connector 10 from being pulled out of the adapter 30.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A plug connector assembly, comprising:

a plug connector having an elastic locking structure for locking to a socket connector, the elastic locking structure includes an elastic arm provided on a housing of the plug connector and a pair of locking protrusions provided on both sides of the elastic arm and is movable between a locking position engaged with the socket connector and an unlocking position separated from the socket connector; and an adapter having a pressing structure and a pull stop structure, the plug connector received within the adapter to mate with the socket connector slidably inserted into the adapter, when the plug connector is received within the adapter, the pressing structure presses and holds the elastic locking structure in the unlocking position, and the pull stop structure abuts the elastic locking structure for preventing the plug connector from being pulled out of the adapter.

2. The plug connector assembly according to claim 1, wherein, when the elastic arm is in a release state in which the elastic arm is not pressed down, the pair of locking protrusions are in the locking position, and when the elastic arm is in a pressed state in which the elastic arm is pressed down, the pair of locking protrusions are in the unlocking position.

3. The plug connector assembly according to claim 2, wherein when the plug connector is received within the adapter, the elastic arm is pressed down by the pressing structure, and the pull stop structure abuts the pair of locking protrusions.

4. The plug connector assembly according to claim 3, wherein the adapter includes an inner housing and an outer housing, the plug connector is received within the inner housing, and the inner housing is received within the outer housing.

5. The plug connector assembly according to claim 4, wherein the pull stop structure includes a pair of pillars formed on the inner housing, front ends of the pair of pillars abut the pair of locking protrusions for preventing the plug connector from being pulled out of the adapter.

6. The plug connector assembly according to claim 5, wherein the pressing structure includes a cross beam connected between the pair of pillars, the cross beam pressing down the elastic arm for biasing the pair of locking protrusions into the unlocking position.

7. The plug connector assembly according to claim 6, wherein the pressing structure further includes a pressing part formed on inner wall of the outer housing, the pressing part pressing down on the elastic arm for biasing the pair of locking protrusions into the unlocking position.

8. The plug connector assembly according to claim 4, wherein the pressing structure includes a pressing part formed on an inner wall of the outer housing, the pressing part pressing down on the elastic arm for biasing the pair of locking protrusions into the unlocking position.

9. The plug connector assembly according to claim 4, wherein an elastic latching structure is provided on two outer side walls of the inner housing, when the inner housing is received within the outer housing, the elastic latching structure is engaged with an inner wall of the outer housing for locking the inner housing to the outer housing.

10. The plug connector assembly according to claim 9, wherein:

the elastic latching structure includes an elastic cantilever and a latching protrusion formed on an outside of the elastic cantilever;

two locking steps are formed on two inner side walls of the outer housing; and when the inner housing is received within the outer housing, the latching protrusion is engaged with the locking step for locking the inner housing to the outer housing.

11. The plug connector assembly according to claim 10, wherein when the inner housing is received within the outer housing, a free end of the elastic cantilever is located outside the outer housing such that the latching protrusion may be separated from the locking step by pressing the free end.

12. The plug connector assembly according to claim 4, wherein the plug connector further includes an unlocking pressing part for biasing the elastic locking structure to the unlocking position.

13. The plug connector assembly according to claim 12, wherein:

the unlocking pressing part is an elastic pressing arm extending obliquely upward from the top of the plug connector; and a first opening and a second opening are respectively formed on top walls of the inner housing and the outer housing of the adapter, the unlocking pressing part being exposed through the first opening and the second opening.

14. The plug connector assembly according to claim 4, wherein the plug connector is installed into the inner housing from a bottom opening of the inner housing, and the inner housing and the plug connector assembled in the inner housing are insertable into the outer housing together.

15. The plug connector assembly according to claim 1, wherein the plug connector is an RJ45 plug connector, and the socket connector is an RJ45 socket connector.

16. A connector assembly, comprising:

a plug connector assembly including:

a plug connector having an elastic locking structure adapted to be locked to a socket connector, the elastic locking structure movable between a locking position engaged with the socket connector and an unlocking position separated from the socket connector; and an adapter having a pressing structure and a pull stop structure, the plug connector received within the adapter to mate with the socket connector slidably inserted into the adapter, when the plug connector is received within the adapter, the pressing structure presses and holds the elastic locking structure in the unlocking position, and the pull stop structure engaging with the elastic locking structure for preventing the plug connector from being pulled out of the adapter; and the socket connector slidably insertable into the adapter of the plug connector assembly for mating with the plug connector assembled in the adapter.

17. The connector assembly according to claim 16, further comprising a locking feature formed on a housing of the socket connector for engaging with the elastic locking structure on the plug connector, wherein when the socket connector is inserted into the adapter and mated with the plug connector, the elastic locking structure is biased into the unlocking position and separated from the locking feature for allowing the socket connector to be pulled out of the adapter via the application of force in a single direction.

18. An adapter for mating a plug connector and a socket connector, including:

a housing for receiving the plug connector and the socket connector, the plug connector and socket connector mated within the adapter, the adapter including:

a pressing structure for pressing and holding an elastic locking structure of the plug connector in an unlocked position when the plug connector is received within the adapter; and a pull stop structure for abutting the elastic locking structure for preventing the plug connector from being pulled out of the adapter.

19. The adapter according to claim 18, wherein the housing includes an outer housing and an inner housing received within the outer housing, the plug connector receivable within the inner housing.

20. The adapter according to claim 19, wherein the pull stop structure includes a pair of pillars formed on the inner housing, front ends of the pair of pillars adapted to abut a pair of locking protrusions of the elastic locking structure for preventing the plug connector from being pulled out of the adapter.

* * * * *